US008668516B2

(12) United States Patent
Lee

(10) Patent No.: US 8,668,516 B2
(45) Date of Patent: Mar. 11, 2014

(54) IDENTIFIABLE PLUG AND PLUG ASSEMBLY HAVING THE SAME

(75) Inventor: Yu-Lung Lee, Miaoli County (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 74 days.

(21) Appl. No.: 12/944,093

(22) Filed: Nov. 11, 2010

(65) Prior Publication Data

US 2012/0045926 A1 Feb. 23, 2012

(30) Foreign Application Priority Data

Aug. 20, 2010 (TW) ..... 99127990 A

(51) Int. Cl.
*H01R 3/00* (2006.01)

(52) U.S. Cl.
USPC ..... 439/489; 439/652; 439/955

(58) Field of Classification Search
USPC ..... 439/488, 535, 652, 651, 518, 489, 955; 174/48
See application file for complete search history.

(56) References Cited

U.S. PATENT DOCUMENTS 4,876,712 A * 10/1989 Brint et al. ..... 379/387.01
4,915,639 A * 4/1990 Cohn et al. ..... 439/188
5,731,763 A * 3/1998 Herweck et al. ..... 340/12.55
5,910,776 A * 6/1999 Black ..... 340/10.1
6,445,087 B1 * 9/2002 Wang et al. ..... 307/40
6,469,901 B1 * 10/2002 Costner ..... 361/730
6,808,396 B2 * 10/2004 Kawaguchi et al. ..... 439/76.1
6,821,157 B2 * 11/2004 Brandstrom et al. ..... 439/638
7,497,740 B2 * 3/2009 Mei et al. ..... 439/652
8,107,243 B2 * 1/2012 Guccione et al. ..... 361/728
8,149,570 B2 * 4/2012 Keebler et al. ..... 361/622
8,388,386 B2 * 3/2013 Petersen ..... 439/676
8,449,318 B2 * 5/2013 Beller et al. ..... 439/489

FOREIGN PATENT DOCUMENTS

CN 101740954 A 6/2010
CN 201498842 U 6/2010

OTHER PUBLICATIONS

Communication From the Chinese Patent Office Regarding a Counterpart Foreign Application Dated Jan. 22, 2013.

* cited by examiner

*Primary Examiner* — Neil Abrams
*Assistant Examiner* — Travis Chambers
(74) *Attorney, Agent, or Firm* — Rosenberg, Klein & Lee

(57) ABSTRACT

An identifiable plug and a plug assembly having the same are disclosed. The identifiable plug includes a power input port, a power output port, a storage unit, a signal transmission unit and a processing unit. The power output port is configured to insert into a plug of electronic equipment. The power input port is connected with the power output port. The processing unit is configured to transmit an identification information stored in the storage unit via the signal transmission unit. When the identifiable plug is assembled with an electric socket, the electric socket is capable to read the identification information.

11 Claims, 9 Drawing Sheets

IDENTIFIABLE PLUG AND PLUG ASSEMBLY HAVING THE SAME

BACKGROUND OF THE INVENTION

1. Field of the Invention

The present invention relates to an identifiable plug and a plug assembly thereof, and particularly to an identifiable plug capable to provide identification information and a plug assembly which may read the identification information from the identifiable plug.

2. Description of Related Art

Plugs of currently available electronic equipments do not provide any identification information of those electronic equipments, such as brands, modes, product series numbers, product specification, required voltage and current. If the users try to control power management or execute remote control of the electronic equipments, they cannot retrieve the identification information thereof and therefore need to input manually.

Therefore, there is a need of a novel plug of electronic equipment which overcomes the above disadvantages.

SUMMARY OF THE INVENTION

The invention provides an identifiable plug and an assembly thereof, in which the identifiable plug stored the identification information of the electronic equipment so that the electric socket may read the identification information when the identifiable plug is inserted in the electric socket.

An embodiment of an identifiable plug according to the present invention includes a body; a first power output port for receiving the insertion of a plug of electronic equipment; a first power input port connected to the first power output port; and a first processing unit coupled to a signal transmission unit and a first memory unit. The first memory unit is configured to store the identification information of the electronic equipment. The first processing unit transmits the identification information via the signal transmission unit.

An embodiment of an identifiable plug assembly according to the invention includes at least one identifiable plug and an electric socket. The identifiable plug has a first power input port, a first power output port, a first processing unit, a signal transmission unit and a first memory unit. The first power input port is connected to the first power output port. The signal transmission unit and the first memory unit are coupled to the first processing unit. The electric socket has a casing, at least one second power output port and a signal receiving unit and connected to the city power supply. A second processing unit and a second memory unit are provided inside the casing. The signal receiving unit and the second memory unit are coupled to the second processing unit. The first power output port is configured to receive the insertion of a plug of electronic equipment. The first power input port detachable with the second power output port. The first processing unit transmits the identification information stored in the first memory unit to the electric socket via the signal transmission unit. The second processing unit receives the identification information via the signal receiving unit and stores the identification information in the second memory unit.

One of the advantages of the invention is in that the identifiable plug may store the identification information of the electronic equipment which is stored in advance by the electronic equipment producer or input by later by the electronic equipment retailer.

Another advantage of the invention is in that there is no need to change or replace any plug or circuit of the electronic equipment for identifying the identification information such as brand, mode, product series number, product specification, and required voltage or current. In addition, the identifiable plug assembly may carry out the identifying process for a plurality of electronic equipments.

Still another advantages of the invention is in that the identifiable plug assembly may transmit the identification information of the electronic equipment to a network so that the there is no need to check or input the identification information for power management.

In order to further the understanding regarding the present invention, the following embodiments are provided along with illustrations to facilitate the disclosure of the present invention.

DETAILED DESCRIPTION OF THE PREFERRED EMBODIMENTS

Figure 1:
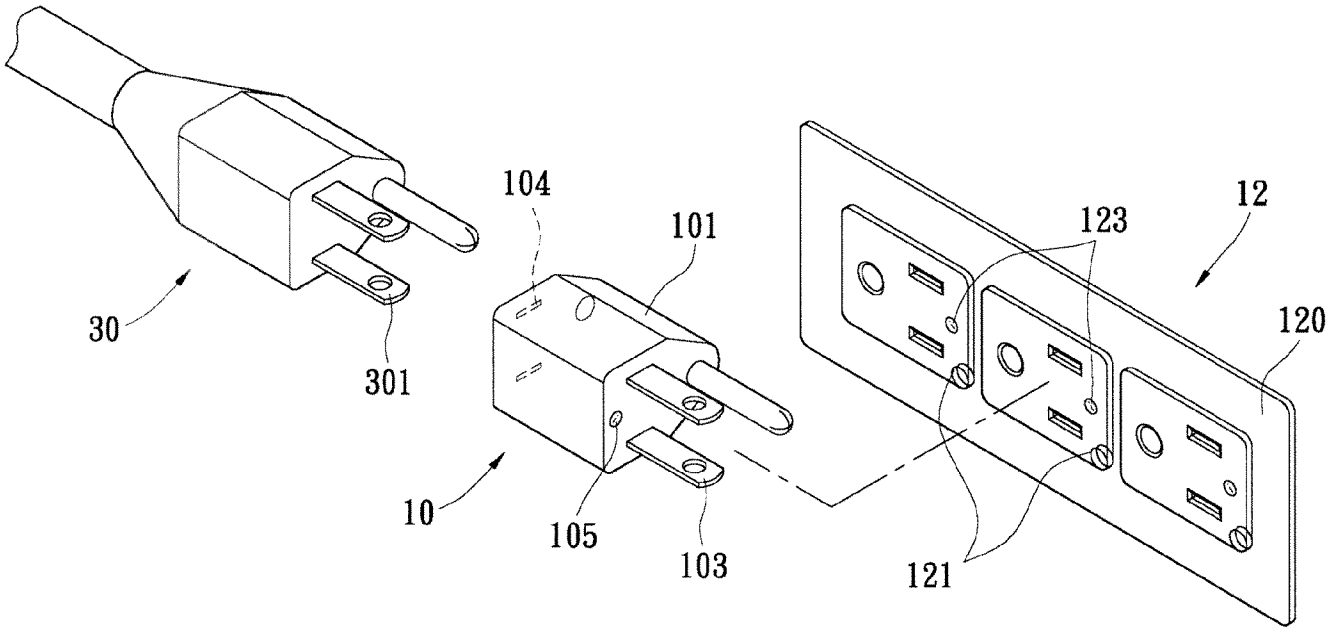
FIG. 1 is a schematic view of an identifiable plug assembly according to a first embodiment of the invention.

FIG. 1 is a schematic view of an identifiable plug assembly according to a first embodiment of the invention. A plug 30 of electronic equipment is inserted in an identifiable plug 10 which stores the identification information for the electronic equipment such as brand, mode, product series, product specification, and required voltage and current. When the identifiable plug 10 is inserted into an electric socket 12, the electric socket 12 is capable to read the identification information of the identifiable plug 10. A producer of the electronic equipment stores the identification information of the electronic equipment in the identifiable plug 10 in advance, and then puts the identifiable plug 10, the plug 30 of the electronic equipment and the electronic equipment together for delivery. If producer of the electronic equipment does not provide the identifiable plug 10, the identifiable plug 10 will be available at retailers and needs to be input with the identification information, so that the identifiable plug 10, the plug 30 of the electronic equipment and the electronic equipment may be sold as a package. Thereby, there is no need of changing the plug 30 of the electronic equipment or any circuits of the electronic equipment for identifying the electronic equipment.

In this embodiment, the identifiable plug 10 has a body 101 with a first power input port 103, a first power output port 104 and a signal transmission unit 105. An electric socket 12 may be a hanging socket which may be hung on any home walls.

The electric socket 12 has a casing 120 having a second power output port 121 and a signal receiving unit 123. The first power input port 103 of the identifiable plug 10 is capable of inserting in the second power output 121 of the electric socket 12. The plug 30 of the electronic equipment has a third power input port 301. The first power output port 104 of the identifiable plug 10 is capable of receiving the third power input port 301. The electric socket 12 is connected to a city power supply so as to supply the power to the third power input port 301 via the second power output port 121, the first power input port 103 and the first power output port 104. The signal transmission unit 105 may be an IR transmission module which is configured to transmit the identification information of the electronic equipment. The signal receiving unit 123 may be an IR receiver module which is configured to receive the identification information.

When the identifiable plug 10 is inserted in the electric socket 12, the signal receiving unit 123 is disposed at a field where signals of the signal transmission unit 105 may be received. Furthermore, if the second power output port 121 may be a receptacle module, then the signal receiving unit 123 may be disposed within an area of the receptacle module.

Figure 2:
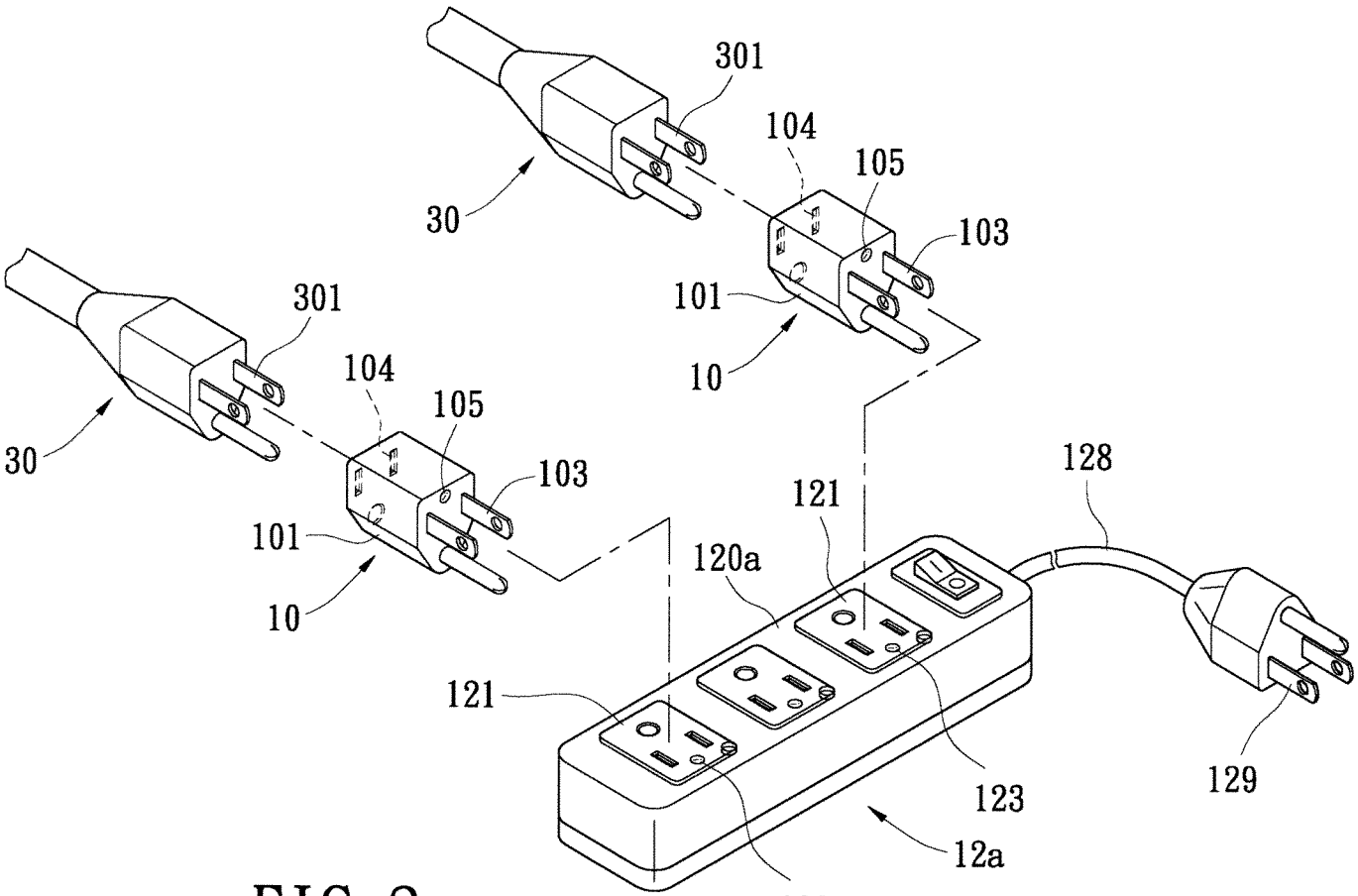
FIG. 2 is a schematic view of an identifiable plug assembly according to a second embodiment of the invention.

FIG. 2 is a schematic view of an identifiable plug assembly according to a second embodiment of the invention. This embodiment is the same as the second embodiment, except that the form of the electric socket is a power strip. The power strip 12*a* has a casing 120*a* which has a plurality of second power output ports 121, a plurality of signal receiving units 123, a power line 128 and a second power input port 129. The second power input port 129 is connected to a power supply. By means of providing a plurality of receiving units 123 at corresponding second power output ports 121, the identification information of individual electric equipments may be read.

Figure 3:
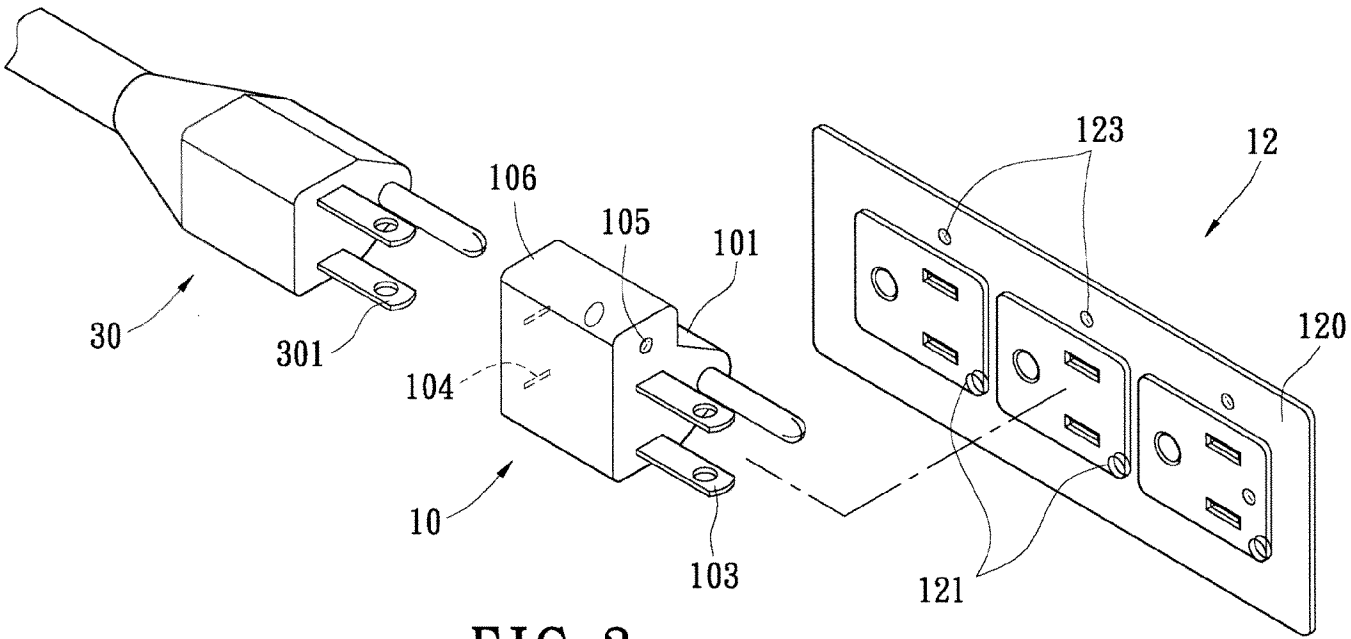
FIG. 3 is a schematic view of an identifiable plug assembly according to a third embodiment of the invention.

FIG. 3 is a schematic view of an identifiable plug assembly of a third embodiment of the invention. This embodiment is the same as the first embodiment, except that a body 101 of the identifiable plug 10 has an extension 106 where the signal transmission unit 105 is disposed on, and the signal receiving units 123 are disposed at the casing 120 of the electric socket 12. When the identifiable plug 10 is inserted in the electric socket 12, the signal receiving units 123 is located at the field where the signals of the signal transmission unit 105 may be received.

Figure 4:
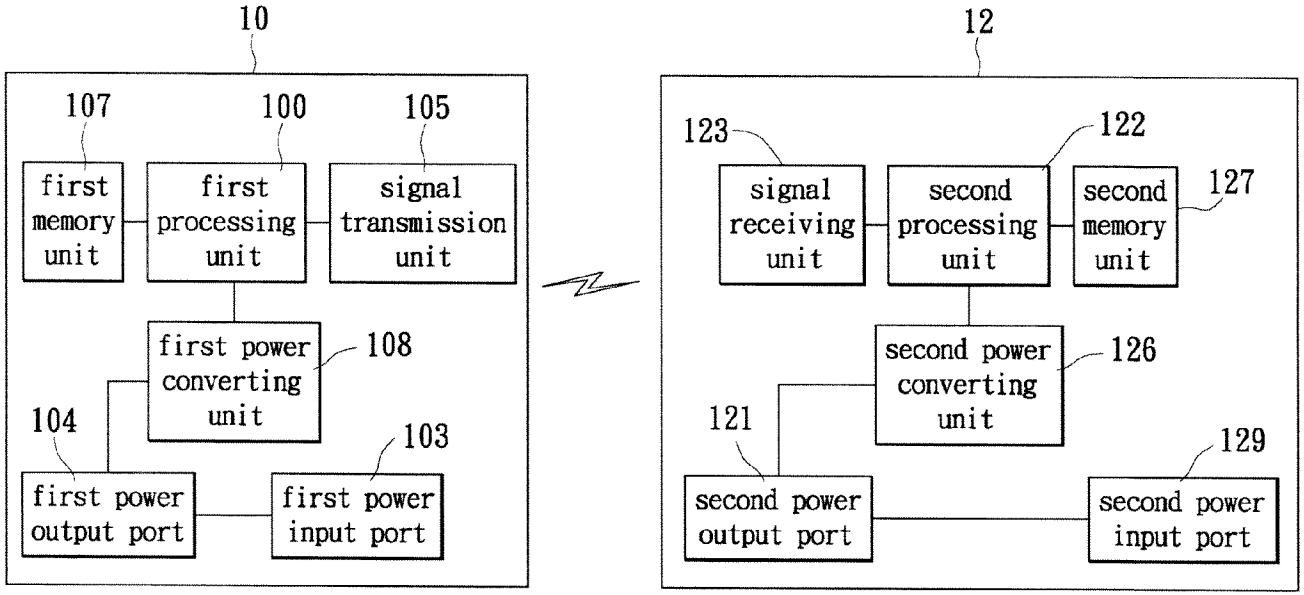
FIG. 4 is a block diagram showing a system function of an identifiable plug assembly according to a fourth embodiment of the invention.

FIG. 4 is a block diagram showing a system function of an identifiable plug assembly according to a fourth embodiment of the invention. The identifiable plug 10 has a first processing unit 100, a first memory unit 107 and a first power converting unit 108. The signal transmission unit 105 and the first memory unit 107 are coupled to the first processing unit 100 which is coupled to the first power converting unit 108. The first power converting unit 108 is coupled to the first power output port 104 to provide a direct current to the first processing unit 100. The first power input port 103 is connected to the first power output port 104 to provide an alternating current.

In this block diagram, the electric socket 12 has a second processing unit 122, a second memory unit 127 and a second power converting unit 126. The signal receiving unit 123 and the second memory unit 127 are coupled to the second processing unit 122 which is coupled to the second power converting unit 126. The second power converting unit 126 is coupled to the second power output port 121 to provide the second processing unit 122 the direct current. The second power output port 121 may be connected to the city power supply. Alternatively, the second power output port 121 is connected to the second power input port 129 and then to the power supply via the second power input port 129.

When the identifiable plug 10 is inserted in the electric socket 12, the first processing unit 100 transmits the identification information stored in the first memory unit 107 to the signal receiving units of the electric socket 12 via the signal transmission unit 105. After the second processing unit 122 receives the signals regarding to the identification information via the signal receiving units 123, the signals regarding to the identification information are stored in the second memory unit 127.

The first memory 107 and the second memory unit 127 may be one of flash memory, random access memory (RAM), Static RAM (SRAM), Synchronous Dynamic RAM (SDRAM), Rambus DRAM (RDRAM), Double Data Rate RAM (DDR-RAM), Virtual Channel Memory RAM, VCM-RAM), Programmable Read Only Memory (PROM), Erasable Programmable Read-Only Memory (EPROM), Electrically Erasable Programmable Read-Only Memory (EEPROM).

Figure 5:
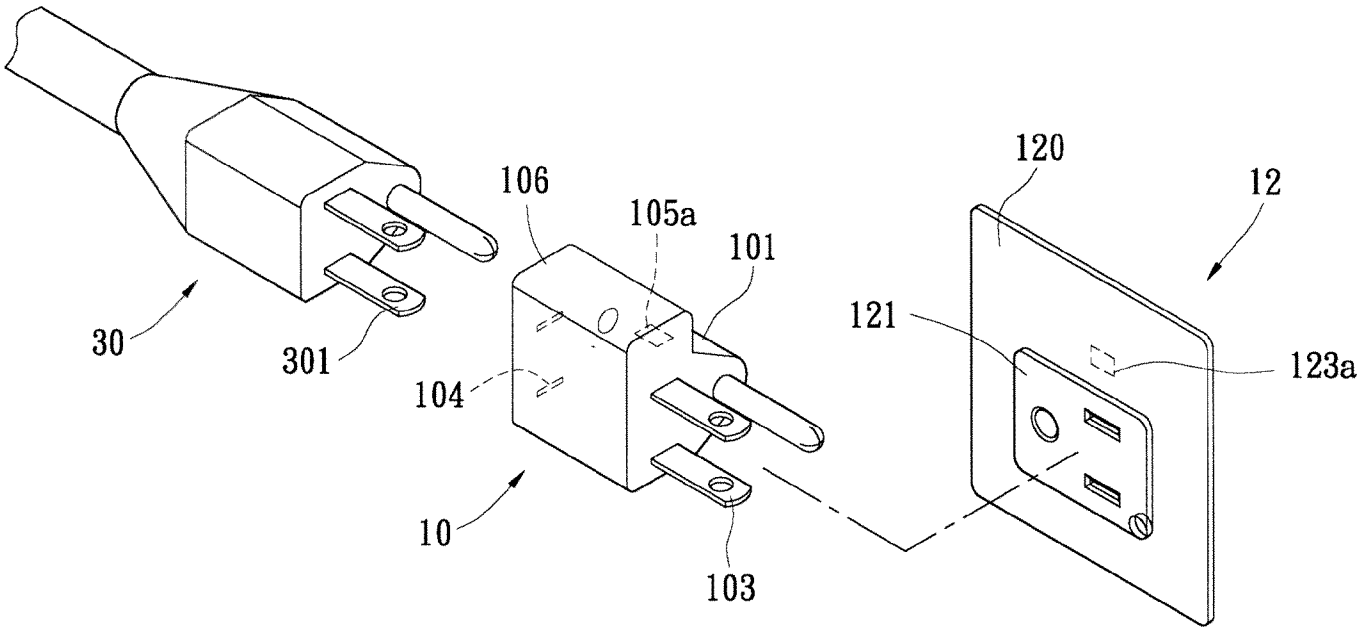
FIG. 5 is a schematic view of an identifiable plug assembly of a fifth embodiment of the invention.

FIG. 5 is a schematic view of an identifiable plug assembly of a fifth embodiment of the invention. This embodiment is the same as the third embodiment, except that the identifiable plug 10 has wireless radio frequency identifying tag 105*a* which is stored by the identification information of the electric equipment. The electric socket 12 has a radio frequency module (RF module) 123*a* whereby the electric socket 12 may read the identification information of the wireless radio frequency identifying tag 105*a* when the identifiable plug 10 is inserted in the electric socket 12. Furthermore, the wireless radio frequency identifying tag 105*a* may be disposed on the extension 106 of the identifiable plug 10.

Figure 6:
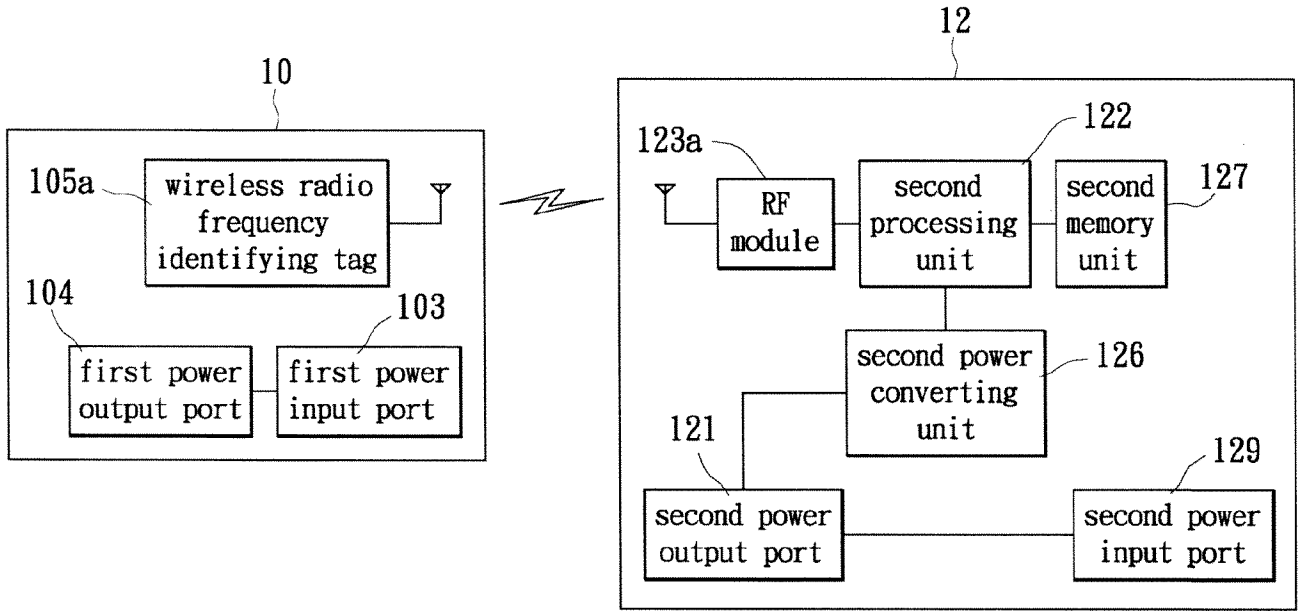
FIG. 6 is a block diagram showing a system function of an identifiable plug assembly according to a sixth embodiment of the invention.

FIG. 6 is a block diagram showing a system function of an identifiable plug assembly according to a sixth embodiment of the invention. The electric socket 12 of the sixth embodiment is the same as that of the fourth embodiment, except that the electric socket 12 of the sixth embodiment has a radio frequency module (RF module) 123*a*. The RF module 123*a* is coupled to the second processing unit 122. When the identifiable plug 10 is inserted in the electric socket 12, the wireless radio frequency identifying tag 105*a* senses the wireless waves emitted from the RF module 123*a* and generates alternating magnetic field which drives the wireless radio frequency identifying tag 105*a* to act. The identification information in the wireless radio frequency identifying tag 105*a* feeds back to the RF module 123*a* and the second processing unit 122. The identification information is then stored in the second memory unit 127.

Figure 7:
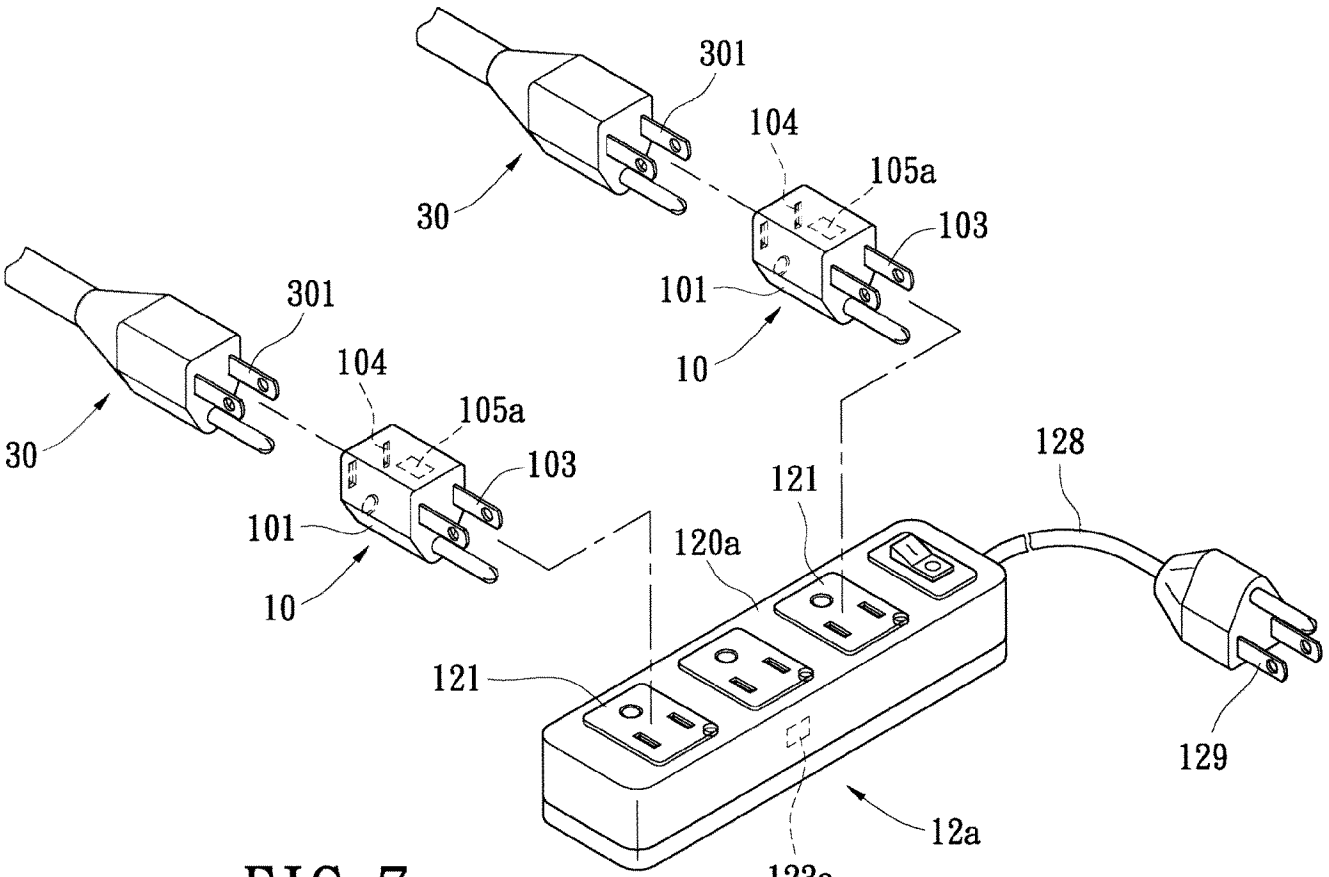
FIG. 7 is a schematic view of an identifiable plug assembly according to a seventh embodiment of the invention.

FIG. 7 is a schematic view of an identifiable plug assembly according to a seventh embodiment of the invention. Referring to FIG. 6 and FIG. 7, if the power strip 12*a* has a plurality of second power output ports 121 and a RF module 123*a*, each of the second power output ports 121 may be connected to a current sensor (not shown). The identifying operation of the wireless radio frequency will be detailed as follows. When any of the identifiable plugs 10 is inserted in any of the second power output ports 121, the second processing unit 122 detects the insertion of any of the identifiable plugs 10 by means of the current sensor of the second power output port 121. The second processing unit 122 commands the RF module 123*a* to emit the wireless waves so that the wireless radio frequency identifying tag 105*a* of the identifiable plug 10 may act and thereby the identification information in the wireless radio frequency identifying tag 105*a* may be read. After reading the identification information, the RF module 123*a* immediately stops emitting the wireless waves. When another identifiable plug 10 is inserted in another second power output port 121, the above identifying operation repeats.

Figure 8:
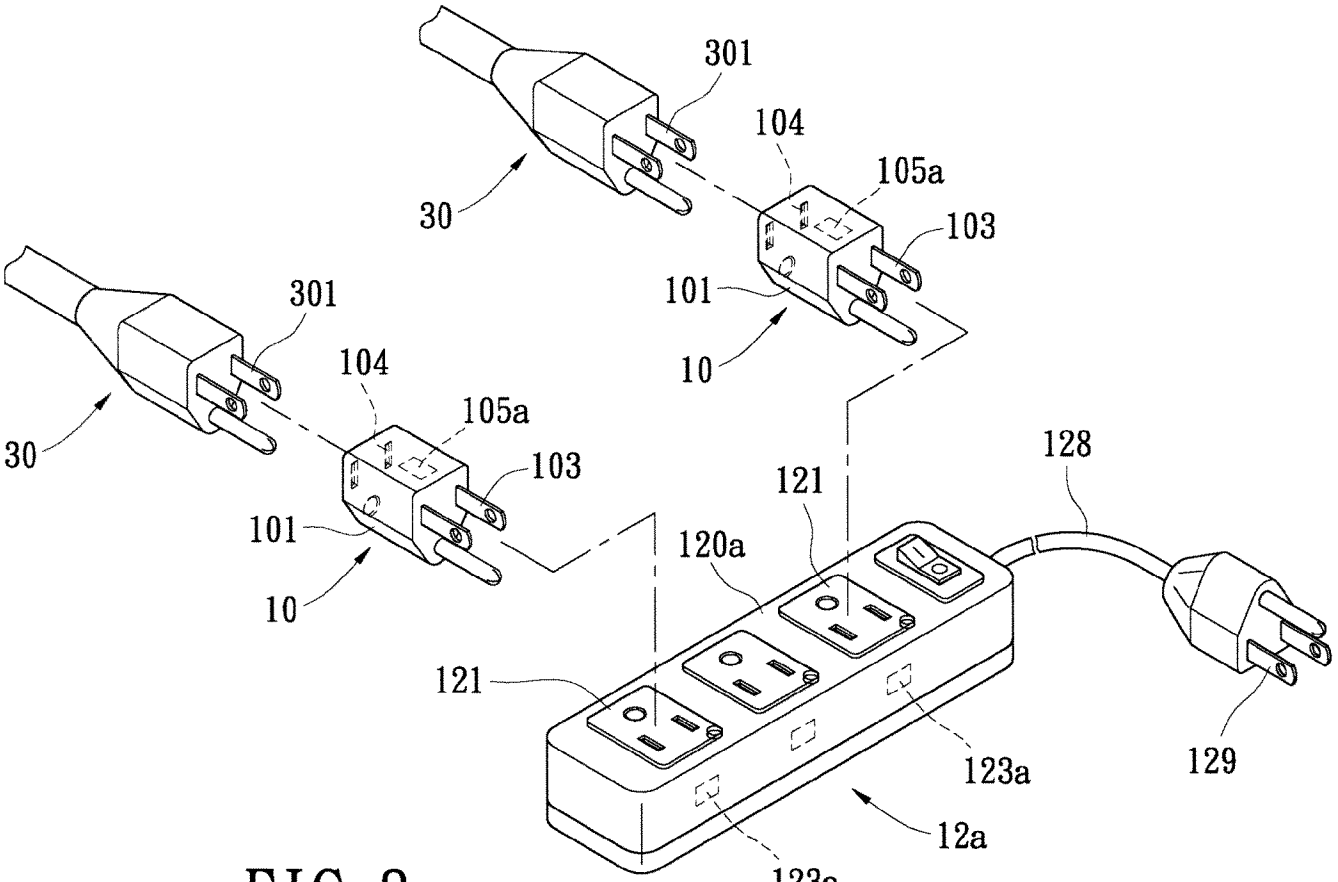
FIG. 8 is a schematic view of an identifiable plug assembly according to an eighth embodiment of the invention.
Figure 9:
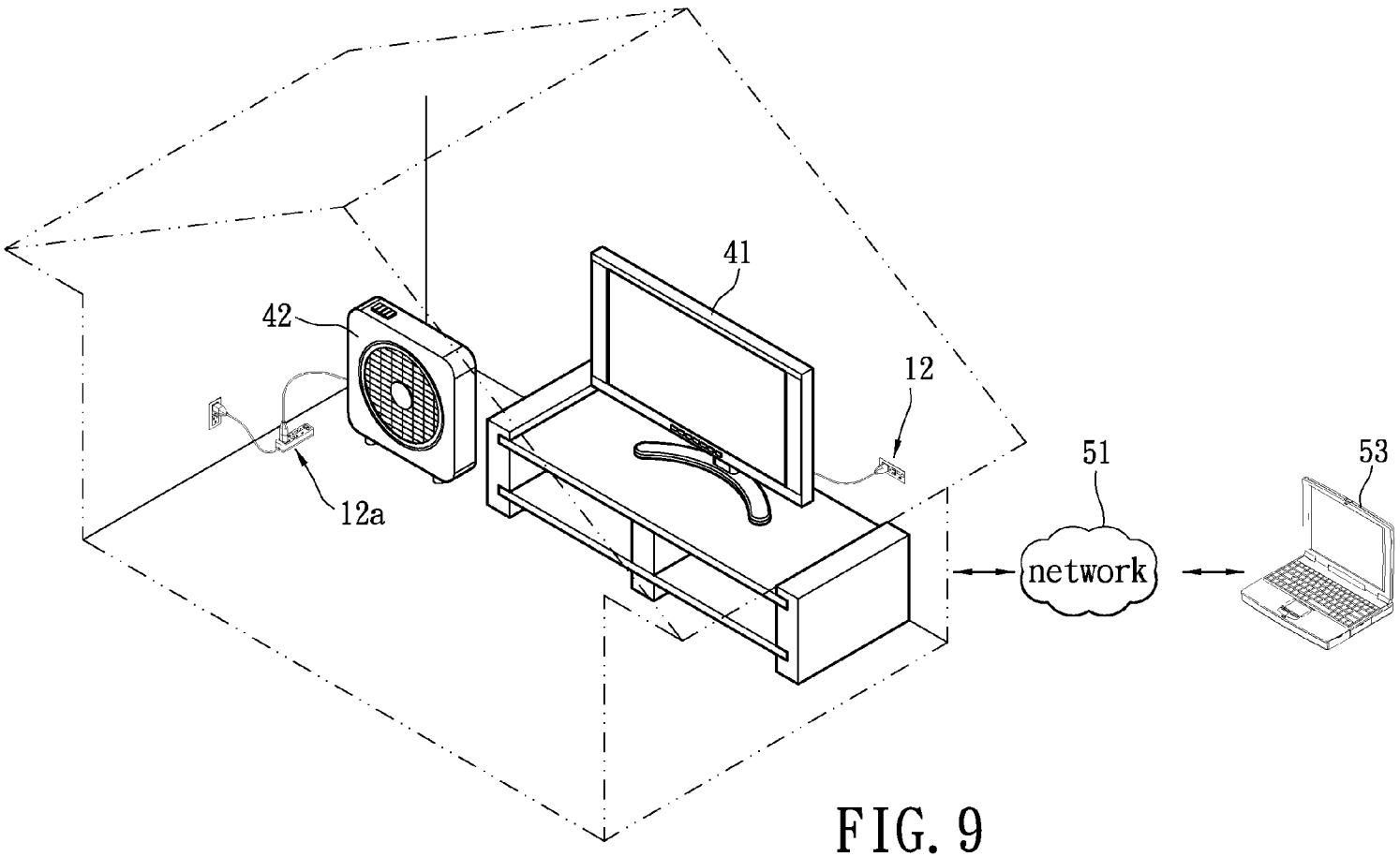
FIG. 9 is a schematic view of an identifiable plug assembly according to a ninth embodiment of the invention.

FIG. 8 is a schematic view of an identifiable plug assembly according to an eighth embodiment of the invention. Referring to FIG. 6 through FIG. 8, if the power strip 12*a* has a plurality of the second power output ports 121 and a plurality of RF module 123*a*. The second processing unit 122 commands the RF modules 123*a* to individually finish the identifying operation. FIG. 9 is a schematic view of an identifiable plug assembly according to a ninth embodiment of the invention. The electric socket 12 or the power strip 12*a* is connected to a network 51 which may be a wire or wireless internet. If the network 51 is wire internet, the electric socket 12 or the power strip 12*a* contains a power line communication (PLC) module (not shown). Thereby, the electric socket 12 or the power strip 12*a* may transmit the identification information of the electronic equipments 41, 42 to a host computer 53 via the network 51. Therefore, the power management port does not need any check or input for the identification information of the electronic equipment. The host computer 53 may be one or more of cell phone, personal digital assistant, desktop computer, notebook, server and workstation. The host computer 53 may utilize the current sensors (not shown) in the electric sockets 12, 12*a* to detect the power consumption.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. An identifiable plug, comprising:

a first power output port for receiving the insertion of a plug of an electronic equipment;

a first power input port connected to the first power output port;

a signal transmission unit;

a first memory unit;

a first processing unit connected electrically to the signal transmission unit and the first memory unit, wherein the first memory unit is configured to store an identification information of the electronic equipment, and the first processing unit transmits the identification information via the signal transmission unit; and a first power converting unit connected in between the first processing unit and the first power output port for providing a direct current.

2. The identifiable plug of claim 1, wherein the signal transmission unit is an IR transmission module, and the identification information includes a brand, a mode, a product series, a product specification, or a required voltage and current for the electronic equipment.

3. The identifiable plug of claim 1, wherein the identifiable plug has an extension where the signal transmission unit is disposed on the extension.

4. The identifiable plug of claim 1, wherein the first memory unit is a flash memory or an Electrically Erasable Programmable read-Only Memory (EEPROM).

5. An identifiable plug assembly, comprising:

an identifiable plug having a first power input port, a first power output port, a first processing unit, a signal transmission unit, a first memory unit, and a first power converting unit, wherein the first power input port is connected to the first power output port, the signal transmission unit and the first memory unit are electrically connected to the first processing unit, and the first power converting unit connected in between the first processing unit and the first power output port for providing a direct current; and an electric socket having a second power output port, a signal receiving unit, a second processing unit, and a second memory unit, wherein the signal receiving unit and the second memory unit are connected electrically to the second processing unit;

wherein the first power output port is configured to receive the insertion of a plug of an electronic equipment, the first power input port is detachable with the second power output port, the first processing unit transmits an identification information stored in the first memory unit to the electric socket via the signal transmission unit, and the second processing unit receives the identification information via the signal receiving unit and stores the identification information in the second memory unit.

6. The identifiable plug assembly of claim 5, wherein the signal transmission unit is an IR transmission module, the signal receiving unit is an IR receiving unit, and the identification information includes a brand, a mode, a product series, a product specification, or a required voltage and current for the electronic equipment.

7. The identifiable plug assembly of claim 5, wherein the second power output port is a receptacle module and the signal receiving unit is located in an area of the receptacle module.

8. The identifiable plug assembly of claim 5, wherein the identifiable plug has an extension, the signal transmission unit is disposed on the extension, and the signal receiving unit is disposed in a field where signals of the signal transmission unit can be received.

9. The identifiable plug assembly of claim 5, wherein the electric socket is a power strip having a plurality of second power output ports, a plurality of current sensors, and a plurality of signal receiving units, the current sensors are respectively connected to the corresponding power output ports, and the electric socket is connected to the wired or wireless network.

10. An identifiable plug assembly, comprising:

an identifiable plug comprising a first power input port, a first power output port, and a wireless radio frequency identifying tag, wherein the first power input port is connected to the first power output port; and an electric socket connected to a power supply, wherein the electric socket is a power strip having a plurality of second power output ports, a processing unit, a plurality of current sensors, and a plurality of radio frequency modules, the current sensors are respectively connected to the corresponding second power output ports;

wherein the first power output port is configured to receive the insertion of a plug of an electronic equipment, the first power input port is detachable with the second power output port, and the processing unit is configured to read an identification information stored in the wireless radio frequency identifying tag via the radio frequency module.

11. The identifiable plug assembly of claim 10, wherein the electric socket is connected to the wired or wireless network.

* * * * *